United States Patent [19]

van Ketel

[11] Patent Number: 4,664,269

[45] Date of Patent: May 12, 1987

[54] CRANE FOR HEAVY LOADS, IN PARTICULAR OFFSHORE CRANE, AND PROCESS FOR THE MOORING OF A CRANE

[75] Inventor: Hendrik van Ketel, Maassluis, Netherlands

[73] Assignee: Gusto Engineering C.V., Netherlands

[21] Appl. No.: 764,076

[22] Filed: Aug. 9, 1985

[30] Foreign Application Priority Data

Aug. 13, 1984 [NL] Netherlands ..... 8402495

[51] Int. Cl.[4] ..... B66C 23/26

[52] U.S. Cl. ..... 212/175; 212/192; 212/239; 212/262

[58] Field of Search ..... 212/189, 190, 193, 192, 212/239, 262, 255, 175; 114/123

[56] References Cited

U.S. PATENT DOCUMENTS 2,883,068 4/1959 McIntyre ..... 212/239
3,768,664 10/1973 Bauer et al. ..... 212/193
3,923,163 12/1975 Brewer ..... 212/239
4,297,961 11/1981 Johnson ..... 114/123

FOREIGN PATENT DOCUMENTS 1180502 10/1964 Fed. Rep. of Germany ..... 114/239
1246969 8/1967 Fed. Rep. of Germany ..... 114/239
1264010 3/1968 Fed. Rep. of Germany ..... 114/239
2642910 3/1978 Fed. Rep. of Germany ..... 114/239

*Primary Examiner*—Joseph F. Peters, Jr.
*Assistant Examiner*—Stephen P. Avila

[57] ABSTRACT

To permit an increase of the maximum permissible load of a crane for heavy loads, in particular an offshore crane, some of the luffing wires for luffing in and out the crane jib (4), are extended by guy wires (17); to avoid the disadvantage that the frame (3) of the crane with tie-back system can not slew, the part of the luffing wires connected with the guy wires, on the one hand, and the part of the luffing wires not connected with said guy wires, on the other, form part of separate hoists (6, 5) which can be operated by separated winches (14, 13).

1 Claim, 4 Drawing Figures

CRANE FOR HEAVY LOADS, IN PARTICULAR OFFSHORE CRANE, AND PROCESS FOR THE MOORING OF A CRANE

The invention relates in the first instance to a crane for heavy loads, in particular an offshore crane, provided with a crane jib which is hingedly connected to a slewing frame disposed on a pontoon or similar floating body, and which by means of luffing wires can be luffed in and out, while to increase the maximum permissible load some of the luffing wires are extended by means of guy wires which are fixed some distance away from the crane.

Cranes with such a "tie-back" system, which extends some of the luffing wires, are known and are used to permit an increase of the maximum permissible load. Both the foundation of the crane and the luffing wires are better loaded through use of the triangle of forces formed. For example, a 2000-tonne crane is made suitable for a load of 3000 tonnes. It is important for the guy wires to be fastened a good distance away from the crane, for example to the deck of the crane pontoon.

A disadvantage of known cranes with tie-back system is that the frame can slew over little or no angle. In fact, a slewable crane becomes a floating derrick. This problem is particularly important if a very heavy load has to be taken from the deck of the crane pontoon itself and slewed to a position outside the pontoon. Such handling of a heavy load is not possible with the known moored cranes. Where the known cranes with fixed mooring are used, the load is always picked up from another pontoon. The work cannot be carried out in rough weather because the strain on the crane during handling of a heavy load can exceed the permissible limit. The advantage of having its own semi-submersible is then lost.

The object of the invention is to avoid this disadvantage and to produce a crane of the type mentioned in the preamble with tie-back system, which is capable of picking up a load from its own deck or a place not far from said deck and slewing it outboard, following which the tie-back system can be produced.

According to the invention, this crane is characterised in that the part of the luffing wires connected with the guy wires, on the one hand, and the luffing wires not connected with the guy wires, on the other, form part of separate hoists which can be operated by separate winches.

A process for the mooring of such a crane is characterised in that a load is hoisted by the crane and the crane jib is maintained in or taken to the fully or virtually fully luffed-in position by means of at least two luffing hoists, each operated by a separate winch, the slewing frame is slewed into a position in which the load hanging on the crane jib is outboard, the luffing hoisting blocks of one of the luffing hoists at the top end of the frame are detached from the frame and are moved downwards to a position on or near the deck, while the crane jib with load is retained by the other luffing hoist with locked winch in the luffed-in state, guy wires are fastened between the detached hoist blocks and a fastening point at a distance from the crane, and the hoist blocks detached from the frame, through the driving of the winch belonging with the hoist of said blocks, are drawn upwards until the wires of said hoist and the guy wires are essentially in line with each other, and finally, the crane jib is released for luffing out by means of all luffing hoists.

The invention will now be explained further with reference to the schematic figures.

Figures 1, 2:
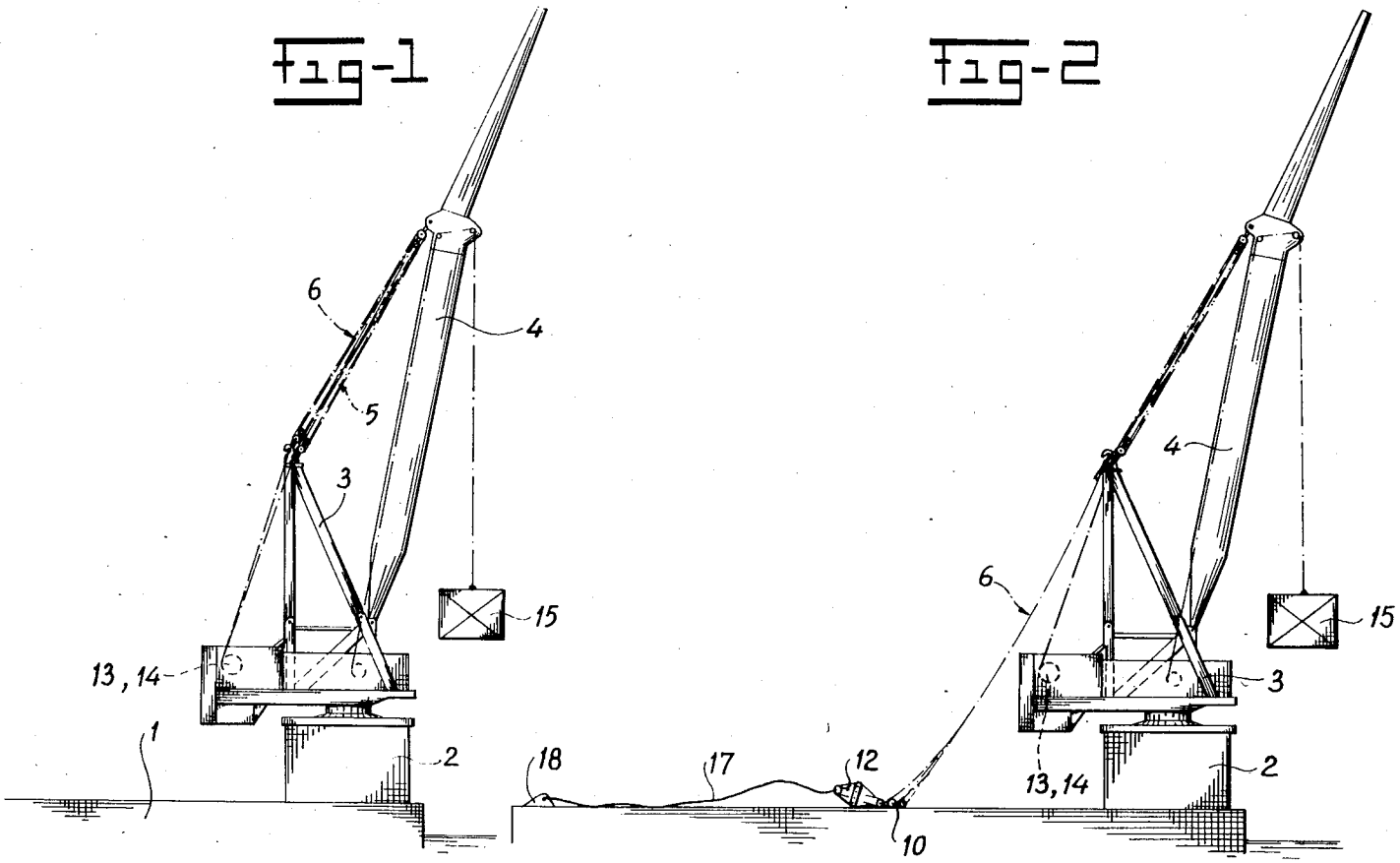
FIGS. 1 to 3 show views of the crane in the various stages which are necessary to produce the special mooring system according to the invention.

The offshore crane shown in the figures comprises a pontoon 1, a support 2, an A-frame 3 slewably mounted on said support and a crane jib 4 which is hingedly connected to said crane frame and can be luffed in and out by means of two separate luffing hoists 5, 6.

Figure 4:
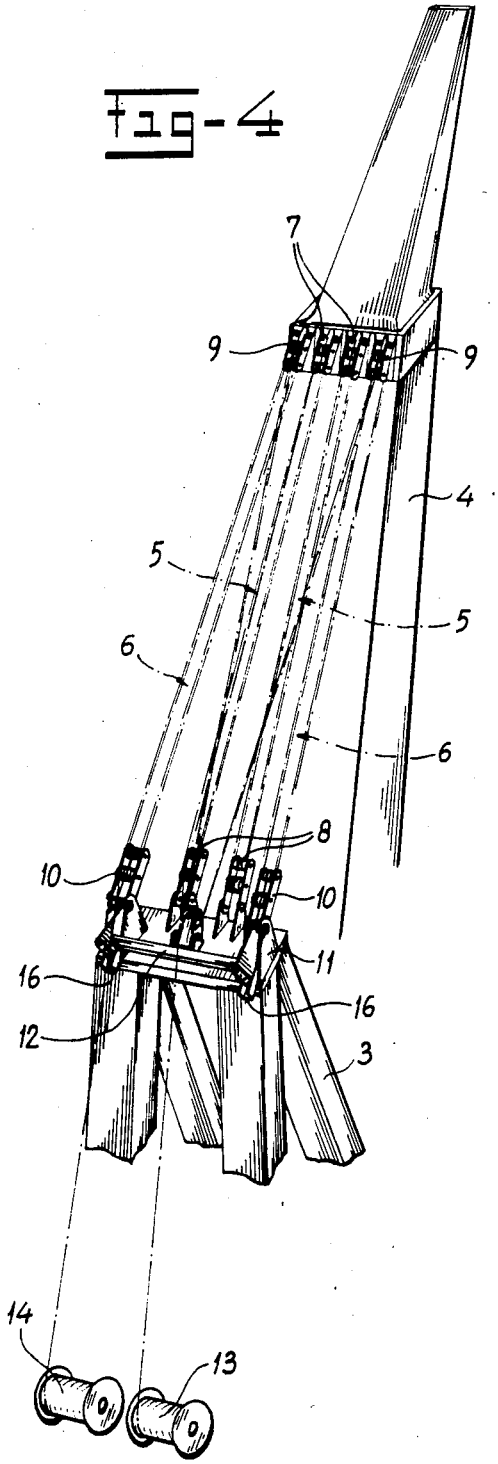
FIG. 4 shows a perspective view of the two separate luffing hoists which are provided between the crane jib and the crane frame.

As can be seen in particular from FIG. 4, the hoist 5 has two top blocks 7 fixed to the crane jib 4, and two bottom blocks 8 fixed to the top of the A-frame. The hoist 6 has two top blocks 9 fixed to the crane jib 4, and two bottom blocks 10 which are detachably connected to the top of the A-frame. The bottom blocks 10 are disposed on the outside of the bottom blocks 8. The hinge pins of the detachable blocks 10 rest in hook-shaped consoles 11 which are open to one side. The blocks 10 are connected to each other by means a U-shaped guide construction 12.

Each of the hoists 5, 6 has its own winch 13 and 14 respectively; so the hoists can be operated independently of each other.

The object of the invention is to moor a slewable crane in the loaded state according to a so-called tie-back system, where as a result of that system the crane becomes essentially not slewable. A slewable crane becomes, as it were, a floating derrick, which means that the frame and the support of the crane can be exposed to considerably greater hoisting stresses. In order to achieve this state with loaded crane, the following procedure is followed:

(a) In the fully luffed-in or relatively little luffed-out position of the jib arm a load 15 is hoisted from its own deck or from a place not far from its own deck (for example, the wharf). There is, however, no reason why the load should not be hoisted with luffed-out crane jib which is moored by means of a mooring system not shown and the crane jib is luffed in, after which said mooring system is removed. In any case, it leads to the load 15 being suspended from the luffed-in, not moored crane jib 4, and all luffing hoists are switched on to keep the jib arm in said luffed-in position.

(b) The frame 3 is slewed on the support 2 to the position shown in FIG. 1, in which the luffed-in crane jib projects beyond the side or rear end of the pontoon 1 and the load 15 is hanging outboard.

(c) The assembly of bottom blocks 10 and U-shaped guide construction 12 is pulled away from the hook-shaped consoles 11 (for example, with an auxiliary winch) and with lowering of hoist 6 by means of winch 14 is moved downwards to the deck of the pontoon 1. In the first part of this downward movement this assembly 10, 12 is guided by the channels 16. The crane jib 4 is now held in its luffed-in position only by the luffing hoist 5.

(d) Guy wires 17 are fastened between a fixed fastening point 18 on the deck and the guide construction 12. This situation is shown in FIG. 2.

Figure 3:
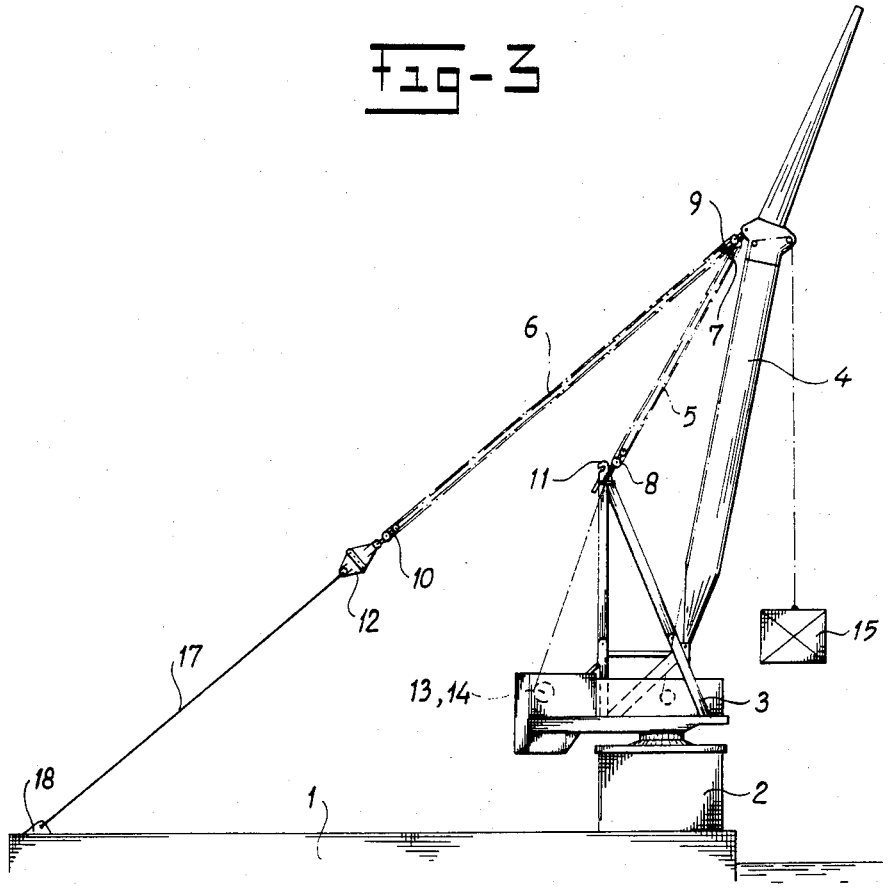

(e) Through driving winch 14, the hoist 6 is shortened to such an extent that the wires of said hoist and the guy wires 17 come to rest in line with each other, so that the assembly of these wires starts to exert its mooring action (See FIG. 3).

The crane is now ready to set down the load 15, by luffing-out of the jib 4 and operation of the hoisting tackles 5,6, in the desired position at a distance from the pontoon 1. During this luffing-out of the arm 4, both hoists 5, 6 are involved. In order to increase the load capacity of the crane, it is important for the fastening point 18 of the guy wires 17 to be as far as possible from the crane. A kink facing away from the crane could even be provided in the assembly of connected guy wires 17 and luffing wires of the luffing hoist 6 by means of a separate mooring mast.

For the present invention, the essential feature is that the crane jib is moored in the loaded state. In order to make this possible, it is necessary for the hoist 6 connected to the guy wires 17 and the hoist 5 to be separate and to be operated by separate winches. While the hoist 6 is connected via the guy wires with the deck, hoist 5 remains in operation.

Various modifications are possible within the framework of the invention. Of course, each of the hoists can have only one bottom block and one top block. Hoists with more than two bottom and top blocks are also possible.

What is claimed is:

1. Process for mooring a crane having a slewing frame disposed on a deck and a crane jib hingedly connected to said slewing frame, and process comprising the steps of:

hoisting a load by the crane and maintaining the crane jib in or taking the crane jib to the fully or virtually fully luffed-in position by means of at least two luffing hoists each operated by a separate winch;

slewing the slewing frame into a position in which the load hanging on the crane jib is outboard;

moving luffing hoisting blocks of one of the luffing hoists which are at the top end of the frame and detached therefrom downwards to a position on or near the deck, while the crane jib with the load is retained by the other luffing hoist with locked winch in the luffed-in state;

fastening guy wires between the detached hoist blocks and a fastening point at a distance from the crane;

drawing the hoist blocks detached from the frame, through the driving of the winch belonging with the hoist of said blocks, upwards until the wires of said hoist and the guy wires are essentially in line with each other;

and finally, releasing the crane jib for luffing out by means of all luffing hoists.

* * * * *